US006226450B1

(12) United States Patent
Lee

(10) Patent No.: US 6,226,450 B1
(45) Date of Patent: May 1, 2001

(54) ELECTRIC FIELD SHIELDING APPARATUS

(76) Inventor: Myoung Jun Lee, 18403 Bechard Ave., Cerritos, CA (US) 90703

( * ) Notice: Subject to any disclaimer, the term of this patent is extended or adjusted under 35 U.S.C. 154(b) by 0 days.

(21) Appl. No.: 09/471,666

(22) Filed: Dec. 24, 1999

Related U.S. Application Data

(63) Continuation-in-part of application No. 09/340,421, filed on Jun. 28, 1999, which is a continuation-in-part of application No. 09/192,957, filed on Nov. 16, 1998, which is a continuation-in-part of application No. 08/785,981, filed on Jan. 21, 1997, now Pat. No. 5,837,971.

(51) Int. Cl.[7] ..... A45D 20/10
(52) U.S. Cl. ..... 392/385; 392/384; 219/225
(58) Field of Search ..... 392/383, 384, 392/385, 379, 380, 381, 404, 409, 476; 219/225, 533

(56) References Cited

U.S. PATENT DOCUMENTS

| | | | | |
|---|---|---|---|---|
| 982,735 | | 1/1911 | McElroy . | |
| 1,415,240 | | 5/1922 | Hynes . | |
| 2,527,026 | | 10/1950 | Mucher | 201/71 |
| 3,227,986 | | 1/1966 | Serdahely et al. | 338/302 |
| 3,627,981 | | 12/1971 | Kuhn | 219/212 |
| 3,646,322 | | 2/1972 | Speekman | 219/549 |
| 3,668,370 | * | 6/1972 | Pattison | 392/385 |
| 3,864,547 | * | 2/1975 | Ray | 392/385 |
| 3,898,427 | | 8/1975 | Levine et al. | 219/522 |
| 4,209,685 | * | 6/1980 | Walter et al. | 219/225 |
| 4,225,775 | * | 9/1980 | Carter | 392/385 |
| 4,281,237 | | 7/1981 | Berenson | 219/511 |
| 4,321,456 | * | 3/1982 | Ohnmacht et al. | 392/385 |
| 4,359,626 | | 11/1982 | Potter | 219/490 |
| 4,485,296 | | 11/1984 | Ueda et al. | 219/505 |
| 4,577,094 | | 3/1986 | Mills | 219/505 |
| 4,596,921 | * | 6/1986 | Hersh et al. | 392/385 |
| 4,685,479 | * | 8/1987 | McClean | 392/385 |
| 4,687,906 | * | 8/1987 | Fujishima et al. | 392/383 |
| 4,742,212 | | 5/1988 | Ishii et al. | 219/549 |
| 4,791,519 | * | 12/1988 | Madsen | 392/385 |
| 4,792,663 | | 12/1988 | Kishimoto et al. | 219/549 |
| 4,885,456 | | 12/1989 | Tanaka et al. | 219/497 |
| 4,910,391 | | 3/1990 | Rowe | 219/549 |
| 4,931,625 | | 6/1990 | Marlinski | 219/528 |
| 5,081,341 | | 1/1992 | Rowe | 219/505 |
| 5,170,043 | | 12/1992 | Gunnufson | 219/528 |
| 5,173,587 | | 12/1992 | Nakano et al. | 219/212 |
| 5,206,485 | | 4/1993 | Srubas et al. | 219/549 |
| 5,218,185 | | 6/1993 | Gross | 219/528 |
| 5,410,127 | | 4/1995 | LaRue et al. | 219/212 |
| 5,465,013 | | 11/1995 | Bassen et al. | 307/91 |
| 5,521,358 | | 5/1996 | Eilentropp | 219/549 |
| 5,641,421 | * | 6/1997 | Manov et al. | 392/385 |
| 5,811,765 | | 9/1998 | Nakagawa et al. | 219/497 |

* cited by examiner

*Primary Examiner*—Teresa Walberg
*Assistant Examiner*—Fadi H. Dahbour
(74) *Attorney, Agent, or Firm*—Lee & Hong

(57) ABSTRACT

An electric field shielding apparatus used with an electrical device comprises a housing body at least partially surrounding the electrical device; and a conductive shield medium arranged with the shape of the housing body to at least partially surround the electrical device to substantially reflect electric field generated from the electrical device. The conductive shield medium is a thin conductive layer coated on interior surface of the housing body. Alternatively, the conductive shield medium is a conductive mesh placed against interior surface of the housing body. In addition, the conductive shield medium may be integrally mixed with the housing body to make the housing body substantially electrically conductive. In other words, the conductive shield medium may be in a powder form which is mixed with plastic power, the mixture of which is then heated and poured into an injection mold to form a housing body of an electric device. To effectively block or absorb the electric field generated from a device, the conductive shield medium is preferably grounded by being connected to a ground prong of a power outlet.

10 Claims, 2 Drawing Sheets

ELECTRIC FIELD SHIELDING APPARATUS

This is a continuation-in-part of application Ser. No. 09/340,421 filed on Jun. 28, 1999, which is a continuation-in-part of application Ser. No. 09/192,957 filed on Nov. 16, 1998, which is a continuation-in-part of application Ser. No. 08/785,981 filed on Jan. 21, 1997, now U.S. Pat. No. 5,837,971, all of which are fully incorporated herein by reference.

BACKGROUND OF THE INVENTION

1. Field of the Invention

This invention relates to an electric field shielding apparatus, and more particularly to consumer electric appliances equipped with electric field shielding apparatus.

2. Discussion of the Related Art

It has been discovered that magnetic and electric fields affect biological matter and, consequently, cause health problems in human. Such health problems may be linked to cancer and other ailments. The electric fields are very common in modem society where consumer electric appliances are frequently used at homes and offices. Commonly, electric field is generated by power lines, transformers and electric motors. The electric blankets or pads which we use to keep warm also generate one or more forms of electric field. Home appliance, such as hair dryer, computer, refrigerator, also causes substantially amount of electric field. In fact, some studies have shown that there may be a direct correlation between electric blankets and certain medical conditions.

As it is well known that the electric field permeates through practically every kind of substances with the exception of conductive or ferromagnetic materials. Thus, attempting to block electric field generated from such appliances as electric blanket, home appliance using ferromagnetic materials may not be practical due to its cost.

SUMMARY OF THE INVENTION

It is an object of the present invention to provide electronic devices having the effect of shielding electric field, preferably by providing conductive wiring therein which is connected to a ground prong of electrical wall receptacles.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an electric field shielding apparatus used with an electrical device comprises a housing body at least partially surrounding the electrical device; and a conductive shield medium arranged with the shape of the housing body to at least partially surround the electrical device to substantially reflect electric field generated from the electrical device.

According to an aspect of the present invention, the conductive shield medium is a thin conductive layer coated on the interior surface of the housing body. Alternatively, the conductive shield medium is a conductive mesh placed against interior surface of the housing body. In addition, the conductive shield medium may be integrally mixed with the housing body to make the housing body substantially electrically conductive. In other words, the conductive AS shield medium may be in a powder form which is mixed with plastic power, the mixture of which is then heated and poured into an injection mold to form a housing body of an electric device.

To effectively block or absorb the electric field generated from a device, the conductive shield medium is preferably grounded by being connected to a ground prong of a power outlet.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Figure 6:
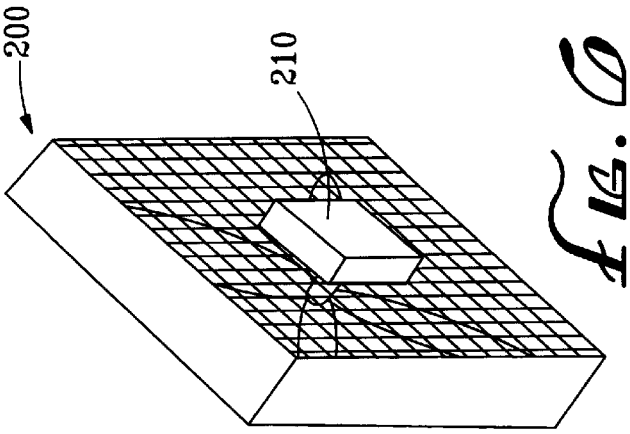
FIG. 6 illustrates an electric fan using the present invention.

An electric field shielding apparatus capable of shielding harmful electric field according to various embodiments of the present invention is shown in the drawings for purposes of illustration.

Figure 1:
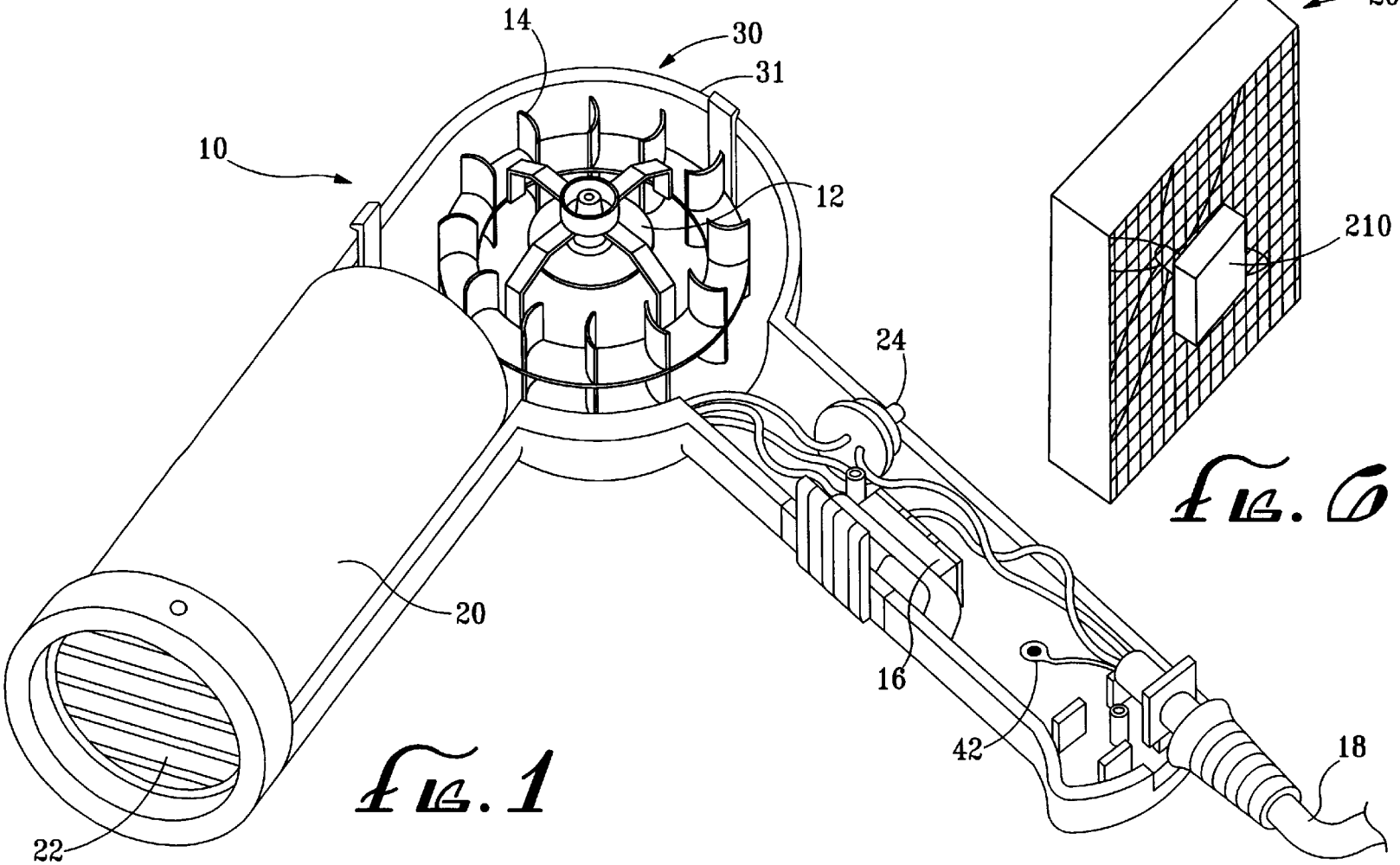
FIG. 1 illustrates a perspective view of interior of a hair dryer using an embodiment of the present invention.

FIG. 1 illustrates a perspective view of interior of a hair dryer 10 using an embodiment of the present invention. The hair dryer 10 is used as an illustration purpose only. The present invention may be used in other consumer electronics or appliances for shielding electric field generated therefrom. The hair dryer 10 generally includes an electrical motor 12 connected to a circular fan 14 which generates stream of air through an opening 22. The electrical motor 12 is energized by an electrical wire 18 which is generally plugged into a wall outlet. The electrical motor 12 is turned on and off by a switch 16. The switch 16 is also connected to a temperature controller 24 which is in turn connected to a heating coil placed inside a cylindrical thermal shield 20 which is typically made of a heat reflecting material.

Figure 2:
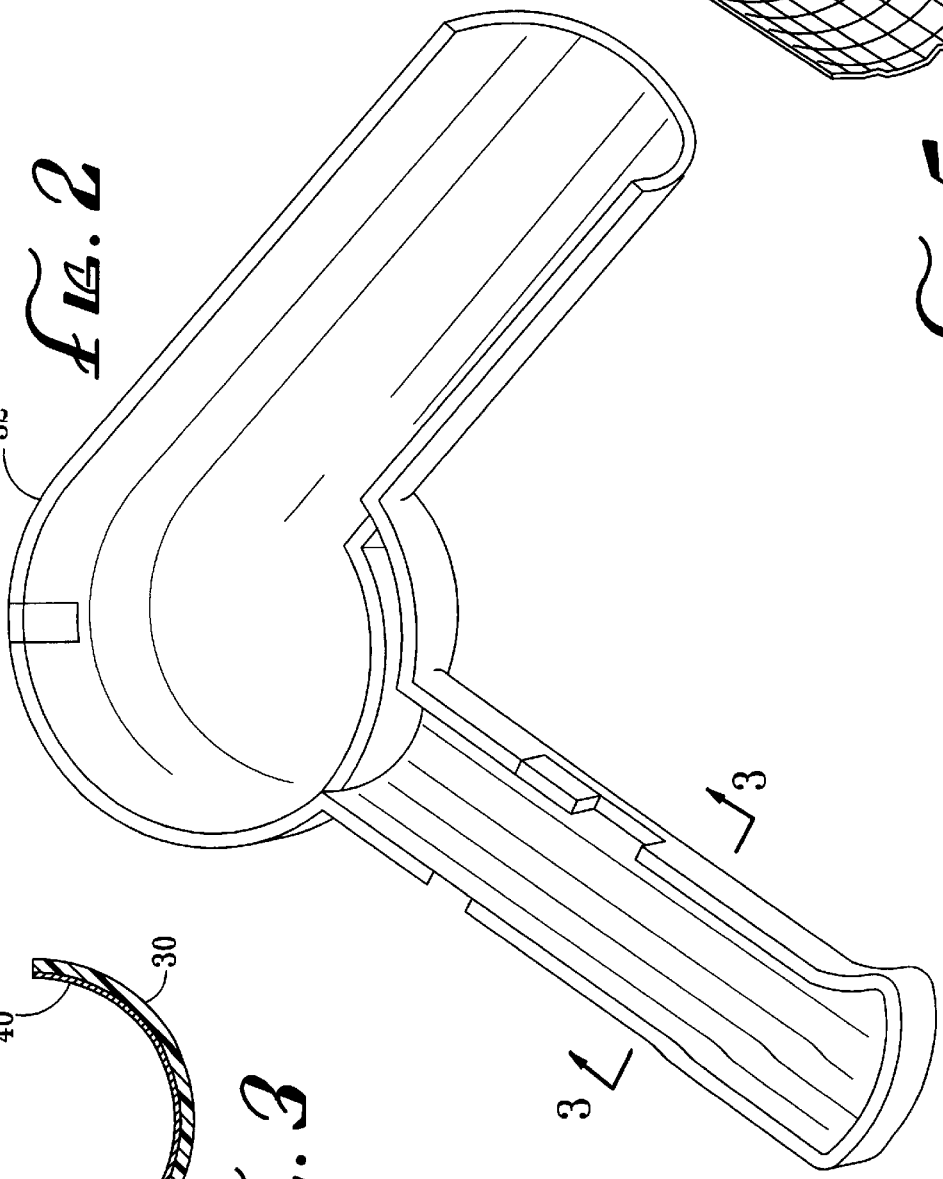
FIG. 2 illustrates a perspective view of interior of the other half of the hair dryer of FIG. 1 using an embodiment of the present invention.

The body 30 of the hair dryer 10 is commonly made with injection molded plastic which is easy and inexpensive to manufacture. All of the internal components of the hair dryer 10 are arranged in various compartments of the inner side of the body 30. The body 30 of the hair dryer 10 is divided into two identical sections 31 and 32, as shown in FIG. 2. First and second sections 31 and 32 are fastened, such as with screws, with respect to each other once internal components are installed therein.

Figure 3:
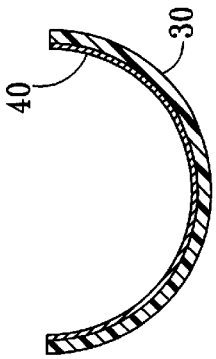
FIG. 3 illustrates a cross-sectional schematic representation of a body of the hair dryer according to the first embodiment of the present invention.

FIG. 2 illustrates a perspective view of interior of the other half 32 of the hair dryer 10 of FIG. 1 using an embodiment of the present invention. FIG. 3 illustrates a cross-sectional schematic representation of the body 30 of the hair dryer 10 according to the first embodiment of the present invention.

In the preferred embodiment of the present invention, the interior surface of the body is substantially lined or spray coated with a shield layer 40 which has capability of substantially blocking electrical field generated from various electrical components, such as motor 12 and heating coil, of the hair dryer 10. Preferably, the shield layer 40 is made of a thin conductive material, such as copper, aluminum, steel or other material known to one of ordinary skill in the art. The thickness of the shield layer 40 is preferably about 1 to 2 microns. It is preferable that the shield layer 40 is placed along and against the entire interior surface of the body 10. Alternatively, the shield layer 40 may be selectively placed and arranged to effectively surround those electrical components that generate most of the electric field, such as the motor 12.

To prevent short circuiting of various electrical components installed in the hair dryer 10, the shield layer 40 is electrically connected to a ground wire 42 as shown in FIG. 1. In the event of a short circuit due to a lose wire, the entire body 30 of the hair dryer 10 is grounded to prevent any electrical shock to a user.

In an alternative embodiment of the present invention, the interior surface of the body 30 may be sprayed or coated with a conductive material.

Figure 4:
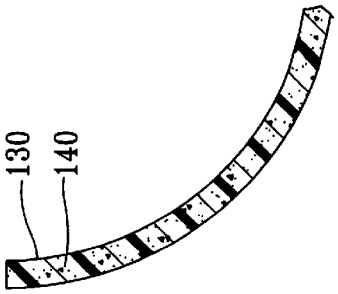
FIG. 4 illustrates a cross-sectional schematic representation of a body of the hair dryer according to the second embodiment of the present invention.

FIG. 4 illustrates a cross-sectional schematic representation of another embodiment of a body 130 of the hair dryer 10 according to the present invention. Instead of having a separate conductive shield layer 40 as illustrated in FIG. 3, the second embodiment of the present invention uses a plastic or non-conductive body 130 which is impregnated with conductive particles 140 so that the entire body 130 becomes a electrically conductive body. Such body 130 can be manufactured by adding conductive particles or powder, such as steel, into melted plastic batch, heating the mixture to a sufficiently high temperature to allow thorough blending of two materials, and then pouring the plastic mixture into an injection mold. Similar to the body 30 laid with a shield layer 40 shown in FIG. 3, the body 130 shown in FIG. 4 is also electrically connected to a ground wire 42 to prevent short circuit and causing electrical shock to a user.

Figure 5:
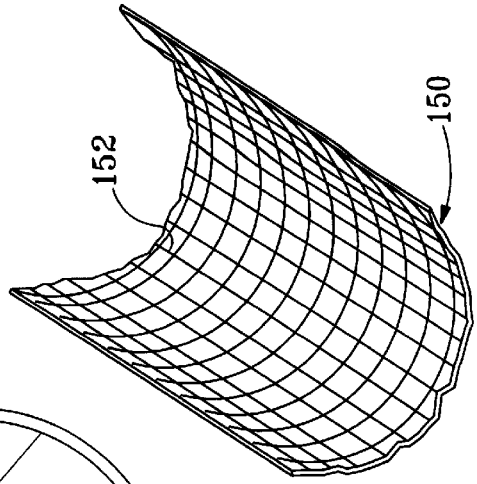
FIG. 5 illustrates a schematic view of a shielding mesh used in the present invention.

FIG. 5 illustrates a schematic view of a shielding mesh 150 used in the present invention. The shielding mesh 150 comprises conductive wires 152 to form a substantially flat and flexible mesh. In the preferred embodiment, the conductive wire 152 of the shielding mesh 150 is a single strand of copper wire having a diameter of about 0.005 to 0.05 mm, and preferably about 0.01 mm. Alternatively, the conductive wire 152 may include a multiple, such as five (5), strands of twisted conductive wires for increased resiliency and flexibility.

The conductive wires 152 may be arranged horizontally and vertically and may be separated by equal distance from adjacent wires. The separation distance or gap between each conductive wire 152 may be adjusted to shield electric field of various frequencies emitted from external source, such as home appliance. For example, if the present invention is used at home with many appliance using 120V line voltage at 60 Hz, then the gap between each conductive wire 152 should preferably be about 2 to 10 mm. Particularly, the horizontal separation distance may be larger than the vertical separation distance. Alternatively, other suitable separation distance may also be used.

The shielding mesh 150 is placed against the interior surface of the body 30 of the hair dryer 10 similar to the cross-sectional view shown in FIG. 3. Alternatively, the shielding mesh 150 may be embedded in the body during the injection molding process. To avoid electrical shortage or shock, the shielding mesh 150 is also connected to a ground wire.

FIG. 6 illustrates an electric fan 200 using the present invention. In particular, the housing body 210 surrounding the electrical motor driving a fan is equipped with similar shielding material. Similar to the body of the hair dryer 10, the housing body 210 may have a conductive shield layer placed against or sprayed on the interior surface of the housing body 210. Alternatively, the housing body 210 may be made of a mixture of plastic and conductive powder which is melted and integrally mixed with the plastic to form a conductive body. Moreover, the housing body 210 may have a shielding mesh, such as the one shown in FIG. 5, disposed against the interior surface of the body to substantially shield the electric field generated from various electrical parts residing in the housing body 210.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein. For example, the present invention may be used with any electronic devices generating electric field. Such devices include, but not limited to, refrigerator, television, cellular phone, etc.

It will be apparent to those skilled in the art that various modifications and variation can be made in the present invention without departing from the spirit or scope of the invention. Thus, it is intended that the present invention covers the modifications and variations of this invention provided they come within the scope of the appended claims and their equivalents.

What is claimed is:

1. An electric heating and field shielding apparatus for generating heated air and used with an electrical motor, the electric field shielding apparatus comprising;

a heating element;

an electrical motor;

a housing body at least partially surrounding the electrical motor; and a conductive shielding medium arranged with the shape of the housing body to at least partially surround the electrical motor to substantially absorb electric field generated from the electrical motor.

2. The electric field shielding apparatus of claim 1, wherein the conductive shield medium is a thin conductive layer coated on an interior surface of the housing body.

3. The electric field shielding apparatus of claim 2, wherein the conductive layer is grounded.

4. The electric field shielding apparatus of claim 1, wherein the conductive shield medium is a conductive mesh placed against interior surface of the housing body.

5. The electric field shielding apparatus of claim 4, wherein the conductive mesh is grounded.

6. A hair dryer having an electric field shielding apparatus and an electrical motor, the hair dryer comprising:

a heating element;

a housing body at least partially surrounding the electrical motor; and a conductive shield medium arranged with the shape of the housing body to at least partially surround the electrical motor to substantially absorb electric field generated from the electrical motor.

7. The hair dryer of claim 6, wherein the conductive shield medium is a thin conductive layer coated on an interior surface of the housing body.

8. The hair dryer of claim 7, wherein the conductive layer is grounded.

9. The hair dryer of claim 6, wherein the conductive shield medium is a conductive mesh placed against interior surface of the housing body.

10. The hair dryer of claim 9, wherein the conductive mesh is grounded.

* * * * *